US005349929A

United States Patent [19]

Shimizu et al.

[11] Patent Number: 5,349,929

[45] Date of Patent: Sep. 27, 1994

[54] VALVE CONTROLLER FOR CONTROLLING THE SUCTION VALVE OF AN INTERNAL-COMBUSTION ENGINE

[75] Inventors: Kiyoshi Shimizu; Yoshihiro Fujiyoshi, both of Saitama, Japan

[73] Assignee: Honda Giken Kogyo Kabushiki Kaisha, Tokyo, Japan

[21] Appl. No.: 87,294

[22] Filed: Jul. 8, 1993

[30] Foreign Application Priority Data

Jul. 8, 1992 [JP] Japan ..... 4-205928

[51] Int. Cl.[5] ..... F01L 1/34

[52] U.S. Cl. ..... 123/90.16; 123/90.17; 123/179.3

[58] Field of Search ..... 123/90.15, 90.16, 90.17, 123/90.39, 179.3

[56] References Cited

U.S. PATENT DOCUMENTS 4,651,684 3/1987 Masuda et al. ..... 123/90.16
4,841,799 6/1989 Entzminger ..... 123/90.16
5,003,939 4/1991 King ..... 123/90.16
5,107,802 4/1992 Yagi et al. ..... 123/90.15
5,165,370 11/1992 Beaumont ..... 123/90.16
5,189,997 3/1993 Schneider ..... 123/90.16

FOREIGN PATENT DOCUMENTS 521412 6/1992 European Pat. Off. .
2-286815 11/1990 Japan .
2231088 11/1990 United Kingdom .

*Primary Examiner*—Carl S. Miller
*Assistant Examiner*—Weilun Lo

[57] ABSTRACT

The lever ratio of rocker arms of an internal-combustion engine is varied to control intake air flow so that the internal-combustion engine can be easily restarted. A query is made to see if the present swing angle is equal to an optimum swing angle for restarting the internal-combustion engine and, if the response is negative, a query is made to see if a motor for changing the lever ratio of the rocker arms is to be driven for rotation in the normal direction. If the motor is to be driven for rotation in the normal direction, the motor is driven accordingly. If the motor is to be driven for rotation in the reverse direction, the motor is driven accordingly.

18 Claims, 13 Drawing Sheets

Fig.6

| | θ ACC1 | θ ACC2 | θ ACC3 | ····· | θ ACC16 | θ ACC17 |
|---|---|---|---|---|---|---|
| NE1 | AGLB(1,1) | AGLB(1,2) | | ····· | | |
| NE2 | AGLB(2,1) | | | ····· | | |
| NE3 | | | | ····· | | |
| ⋮ | ⋮ | ⋮ | ⋮ | ····· ····· ····· | ⋮ | ⋮ |
| NE19 | | | | | | |
| NE20 | | | | | | AGLB(20,17) |

VALVE CONTROLLER FOR CONTROLLING THE SUCTION VALVE OF AN INTERNAL-COMBUSTION ENGINE

DETAILED DESCRIPTION OF THE INVENTION

1. Field of the Invention

The present invention relates to a valve controller for an internal-combustion engine and, more particularly, to a valve controller for an internal-combustion engine, capable of optionally controlling the operation for timing the operation of the suction valve.

2. Description of Related Art

A known valve controller is disclosed in Japanese Patent Laid-open (Kokai) No. 2-286815, which controls the suction valve of an internal-combustion engine. This known valve controller includes a cylinder head, a camshaft provided with cams and disposed in the upper portion of the cylinder head, a suction valve, an exhaust valve, rocker arms pivotally supported on a shaft so as to be driven for rocking motion by the cams of the camshaft to operate the suction valve and the exhaust valve, for controlling intake air flow by varying the lever ratio specifying the distance between the axis of the shaft supporting the rocker arms and a point on the rocker arm at which the cam applies pressure to the rocker arm.

This known valve controller has a camshaft support arm pivotally supported on a shaft disposed in the lower portion of the cylinder head and supporting the camshaft on its free end, and varies the time when the suction valve is opened and the lift of the suction valve by turning the camshaft support arm to vary the phase angle of the cam and the lever ratio of the rocker arm according to the variation of the engine speed. Thus, the suction valve is operated in an optimum mode according to the operating condition of the internal-combustion engine, which reduces the fuel consumption of the internal-combustion engine and improves the performance of the same.

This known valve controller, however, holds valve operating conditions determined immediately before stopping the internal-combustion engine while the internal-combustion engine is stopped, and the valve operating conditions are not necessarily appropriate to restarting the internal-combustion engine. Therefore, it is possible that the valve operating conditions deteriorates the starting performance of the internal-combustion engine.

SUMMARY AND OBJECTS OF THE INVENTION

The present invention has been made in view of such a problem and it is therefore an object of the present invention to provide a valve controller for controlling the operation of the suction valve of an internal-combustion engine, capable of optionally controlling the operating conditions of the suction valve and of maintaining satisfactory starting performance of the internal-combustion engine.

An object of the present invention is to provide a valve controller for controlling the suction valve of an internal-combustion engine having a cylinder head, a cam-shaft provided with cams and disposed in the upper portion of the cylinder head, a suction valve and an exhaust valve, rocker arms pivotally supported on a shaft so as to be driven for rocking motion by the cams of the camshaft to operate the suction valve and the exhaust valve, the lever ratio of the rocker arm specifying the distance between the axis of the shaft supporting the rocker arm and a point on the rocker arm at which the cam applies pressure to the rocker arm being variable to regulate intake air flow, said valve controller comprising: a lever ratio detecting means for detecting the lever ratio of the rocker arm; an operating condition detecting means for detecting the operating conditions of the internal-combustion engine including at least the load on the internal-combustion engine and the engine speed of the internal-combustion engine; an air-fuel ratio detecting means for detecting the air-fuel ratio of the air-fuel mixture on the basis of the oxygen concentration of the exhaust gas; a desired lever ratio calculating means for calculating a desired lever ratio on the basis of detection signals provided by the operating condition detecting means and the air-fuel ratio detecting means; a lever ratio regulating means for adjusting the lever ratio detected by the lever ratio detecting means to the desired lever ratio calculated by the desired lever ratio calculating means; and a starting lever ratio setting means for setting an optimum starting lever ratio optimum for the operation of the internal-combustion engine during cranking when restarting the internal-combustion engine.

The valve controller may further comprise a water temperature detecting means for detecting the temperature of the cooling water of the internal-combustion engine and a supply voltage detecting means for detecting the supply voltage of the battery, wherein the starting lever ratio setting means determines an optimum starting lever ratio on the basis of at least the detection signal provided by the water temperature detecting means or the detection signal provided by the supply voltage detecting means.

The starting lever ratio setting means operates in a predetermined period after the internal-combustion engine has been stopped or during cranking for restarting the internal-combustion engine.

When the optimum starting lever ratio setting means operates during cranking for restarting the internal-combustion engine, a power feed control means inhibits power feed to the starting motor when the temperature of the engine cooling water or the supply voltage of the battery is equal to or below a fixed value and removes the inhibition of power feed to the starting motor when an optimum starting lever ratio is set by the starting lever ratio setting means.

A desired lever ratio is calculated on the basis of the output signals of the operating condition detecting means and the air-fuel ratio detecting means, the lever ratio of the rocker arm is detected and the lever ratio is adjusted to the desired lever ratio by feedback control. The intake air flow is controlled on the basis of the lever ratio to adjust the air-fuel ratio of the air-fuel mixture to a desired air-fuel ratio.

The optimum starting lever ratio optimum for restarting the internal-combustion engine is set immediately after the internal-combustion engine has been stopped or during cranking for restarting the internal-combustion engine according to the temperature of the engine cooling water and the supply voltage of the battery.

When setting the starting lever ratio during cranking for restarting the internal-combustion engine, power feed to the starting motor is inhibited when the temperature of the engine cooling water or the supply voltage of the battery is equal to or below the fixed value to obviate the simultaneous execution of the cranking operation and the starting lever ratio setting operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 is an AGLB map;

DESCRIPTION OF THE PREFERRED EMBODIMENTS

A valve controller in a preferred embodiment according to the present invention will be described hereinafter with reference to the accompanying drawings.

Figure 1:
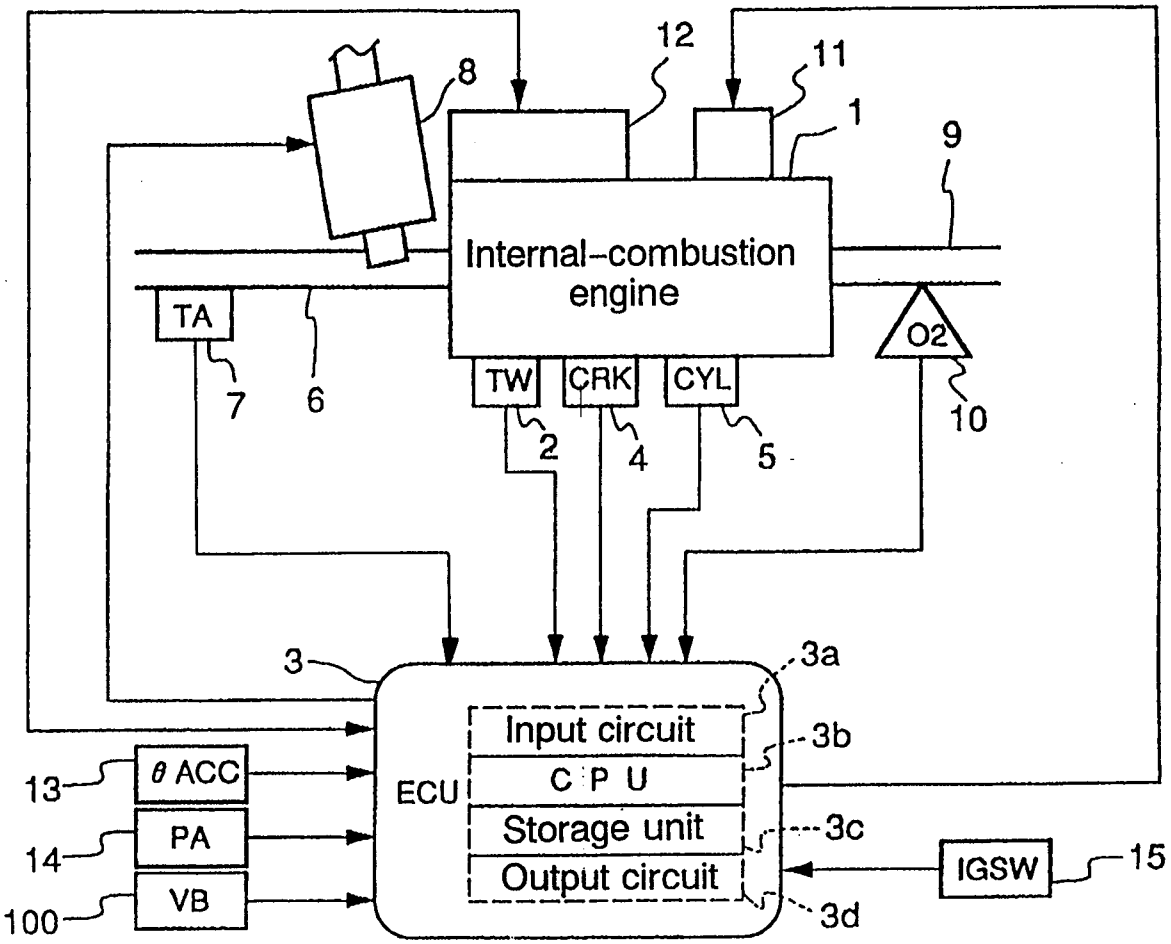
FIG. 1 is a block diagram of a valve driving mechanism.

FIG. 1 is a block diagram of a valve controller for controlling the valve of an internal-combustion engine, in a preferred embodiment according to the present invention.

Referring to FIG. 1, a straight type four-cylinder internal-combustion engine (hereinafter referred to simply as "engine") 1 has a cylinder block having a wall surrounding engine cylinders and provided on its inner surface with a temperature sensor 2, such as a thermistor, for detecting the temperature TW of the engine cooling water. The temperature sensor 2 gives an electric signal representing the temperature TW of the engine cooling water to an electronic control unit (hereinafter abbreviated to "ECU") 3.

A crank angle detector (CRK detector) 4 for detecting the crank angle of the crankshaft, and a cylinder distinguishing sensor (CYL sensor) 5 are disposed around the camshaft or the crankshaft of the engine 1.

The CRK detector 4 provides a pulse (CRK pulse) every time the crankshaft turns through a fixed angle, such as 30°, the CYL sensor 5 provides a pulse (hereinafter referred to as "CYL pulse") when the crank for a specified cylinder is at a specified crank angle, for example an angle 90° before the top dead center (TDC). The CRK pulse and the CYL pulse are sent to the ECU 3.

An intake air temperature (TA) sensor 7 is attached to the wall of a suction pipe 6 connected to the suction port of the engine 1. The TA sensor 7 gives an electric signal representing an intake air temperature TA to the ECU 3.

A fuel injection valve 8 is disposed slightly before each of the suction valves of the engine 1. The fuel injection valve 8 is connected mechanically to a fuel pump, not shown, and electrically to the ECU 3. The fuel injecting time (TOUT) of the fuel injection valve 8 is controlled by the ECU 3.

An oxygen concentration detector ($O_2$ detector) 10 is disposed on an exhaust pipe 9 connected to the exhaust port of the engine 1. The $O_2$ detector 10 gives an electric signal representing the oxygen concentration of the exhaust gas to the ECU 3.

The ECU 3 is connected electrically to ignition plugs 11 for the cylinders of the engine 1 to control the ignition angle ΘIG for each ignition plug 11.

A valve control system 12 is disposed on the cylinder head of the engine 1. The valve control system 12 is connected electrically to the ECU 3 to control the operation of the suction valves.

Arranged at appropriate positions on the engine 1 are an accelerator position (ΘACC) detector 13, a PA sensor for detecting the atmospheric pressure (PA), an ignition switch (IGSW) 15 and a VB detector 100 for detecting the supply voltage (VB) of the battery. The ΘACC detector 13, the PA sensor 14, the IGSW 15 and the VB detector 100 are connected electrically to the ECU 3 and supply their detection signals to the ECU 3.

The ECU 3 comprises an input circuit **3*a* for shaping the waveforms of the input signals given thereto by those sensors and detectors, adjusting the voltage levels of the input signals to a fixed level and converting the analog input signals into corresponding digital signals, a central processing unit (CPU) 3*b*, a storage unit 3*c* comprising a ROM storing operation programs to be executed by the CPU 3*b* and predetermined maps and a RAM for storing the results of operation, and an output circuit 3*d* for applying driving signals to the fuel injection valves 8, the ignition plugs 11 and the valve control system 12**.

The ECU 3 (CPU **3*b***) counts the intervals of the CRK pulses generated at fixed crank angles to calculate a CRME value, provides a TDC distinguishing signal every turn of the crankshaft through an angle of 180°, adds the CRME values provided in the duration of the TDC distinguishing signal to calculate a ME value, which is the reciprocal of the engine speed NE.

The valve control system 12 will be described in detail hereinafter. The valve control system 12 comprises a valve driving mechanism and a rocking angle control mechanism. First the valve driving mechanism will be described.

Figure 2:
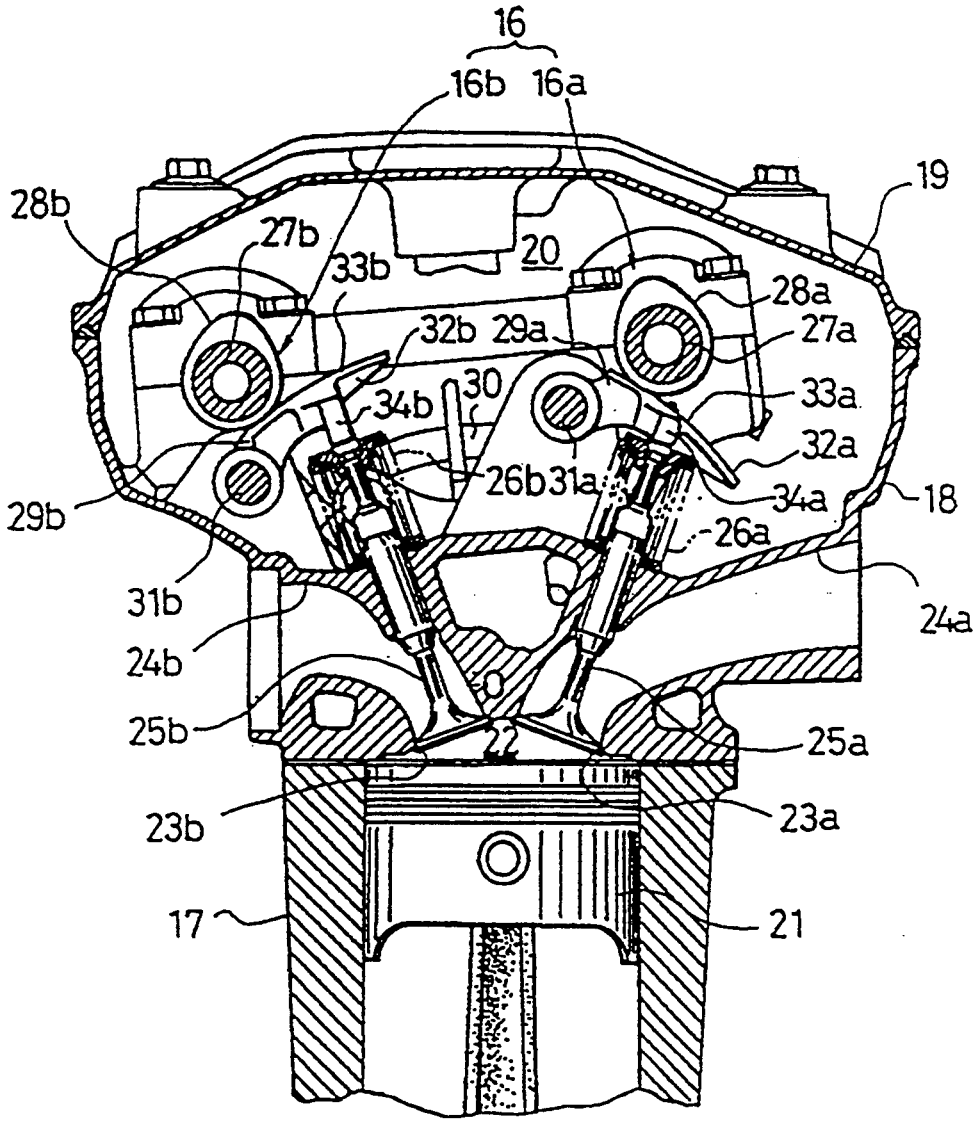
FIG. 2 is a sectional view of a valve controller for controlling the suction valve of an internal-combustion engine, in a preferred embodiment according to the present invention.

Referring to FIG. 2, the valve driving mechanism 16 is disposed in a valve chamber 20 defined by a cylinder head 18 mounted on a cylinder block 17, and a cylinder head cover 19, and comprises a suction valve driving mechanism 16*a* and an exhaust valve driving mechanism 16*b*.

Combustion chambers 22 are formed between the upper surfaces of pistons 21 fitted in cylinders formed in the cylinder block 17, and the cylinder head 18. A suction opening 23*a* and an exhaust opening 23*b* are formed in the cylinder head 18 so as to open into each combustion chamber 22. The suction opening 23*a* and the exhaust opening 23*b* are connected respectively to a suction port 24*a* and an exhaust port 24*b*. A suction valve 25*a* and an exhaust valve 25*b* are placed respectively in the suction opening 23*a* and the exhaust opening 23*b*. The suction valve 25*a* and the exhaust valve 25*b* are biased by valve springs 26*a* and 26*b* so as to close the suction opening 23*a* and the exhaust opening 23*b*, respectively.

The suction valve driving mechanism 16*a* (the exhaust valve driving mechanism 16*b*) comprises a camshaft 27*a* (27*b*), a cam 28*a* (28*b*) fixedly mounted on the camshaft 27*a* (27*b*) for rotation together with the camshaft 27*a* (27*b*), and a rocker arm 29*a* (29*b*) in sliding contact with the cam 28*a* (28*b*). The valve driving mechanism 16 has a camshaft support arm 30 having a base end pivotally supported on a support shaft disposed in the lower portion of the cylinder head 18 and supporting the camshafts 27*a* and 27*b*. The rocker arms 29*a* and 29*b* are supported pivotally for rocking motion on shafts 31*a* and 31*b*, respectively, supported on the cylinder head 18. The rocker arm 29*a* (29*b*) has a shape substantially resembling an arc of a circle and has an upward convex slipper surface 33*a* (33*b*) in sliding contact with the cam 28*a* (28*b*). A pressing portion 34*a* (34*b*) formed at a position corresponding to the slipper surface 33*a* (33*b*) on the lower surface of the rocker arm 29*a* (29*b*) is in contact with the upper ends of the stem of the suction valve 25*a* (the exhaust valve 25*b*) to depress the suction valve 25*a* (the exhaust valve 25*b*) by the rocker arm 29*a* (29*b*).

Figure 3:
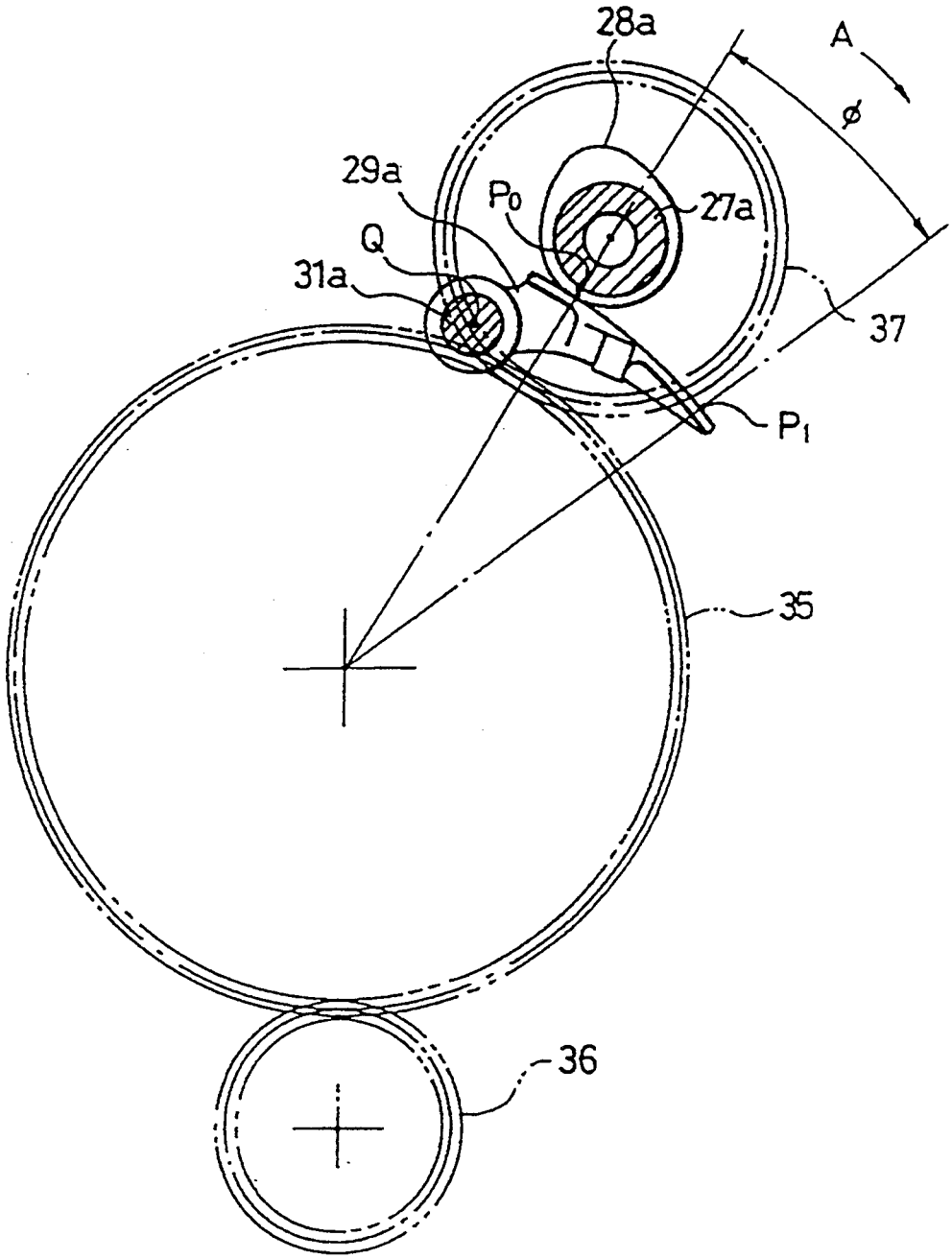
FIG. 3 is a diagrammatic view of a transmission system for transmitting power to the valve driving mechanism.

A driving system for driving the suction valve driving mechanism 16*a* will be described by way of example. FIG. 3 is a diagrammatic view of a transmission system for transmitting the rotation of the crankshaft to the camshaft 27*a* to drive the cam shaft 27*a* for rotation.

A suction valve driving gear 35 (idle gear) is mounted rotatably on one end of a shaft extended longitudinally in the lower portion of the cylinder head 18 across all the cylinders. The suction valve driving gear 35 is in mesh with a driving pinion 36 to which the rotative power of the crankshaft is transmitted through a transmission system, not shown, and in mesh with a driven gear 37 fixedly mounted on one end of the camshaft 27*a*. The rotation of the crankshaft is transmitted through the driving pinion 36, the driving gear 35 and the driven gear 37 to rotate the camshaft 27*a* at a rotating speed half the rotating speed of the crankshaft.

In the suction valve driving mechanism 16*a*, the lever ratio $\eta$ of the rocker arm 29*a* is a minimum lever ratio $QP_o$, when the camshaft support arm 30 is positioned so that the cam 28*a* is at a position nearest to the shaft 31*a*. When the camshaft support arm 30 is turned through an angle $\phi$ in the direction of the arrow A, the lever ratio $\eta$ of the rocker arm 29*a* increases from the minimum lever ratio $QP_o$ to a lever ratio $QP_1$, to delay the suction valve lifting timing by a phase angle dependent on the angle $\phi$ and the gear ratio between the driving gear 35 and the driven gear 37 and to increase the lift of the suction valve 25*a*.

Figure 4:
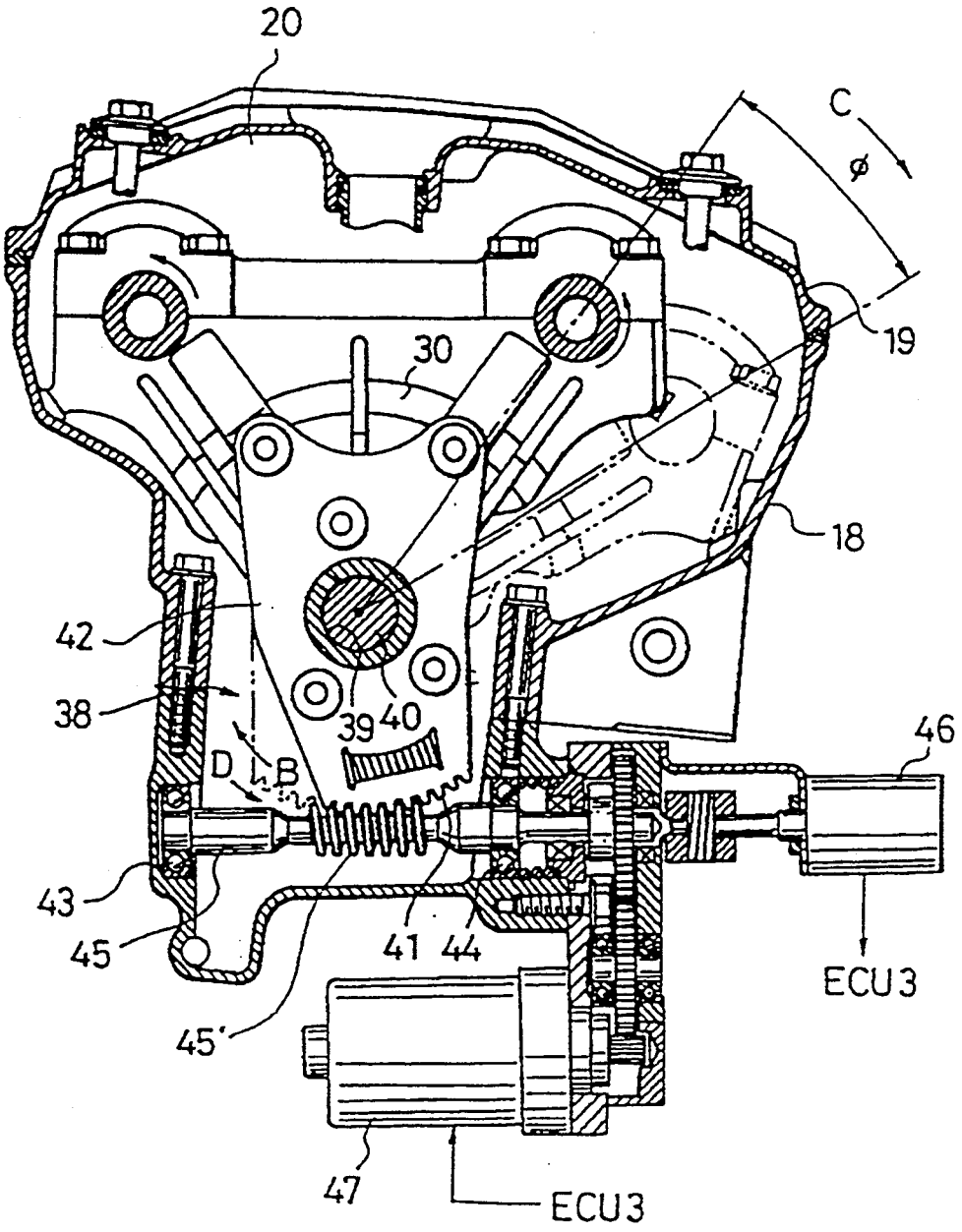
FIG. 4 is a sectional view of a swing angle regulating mechanism.

A camshaft support arm angular position regulating mechanism 38 will be described hereinafter. FIG. 4 is a sectional view of the camshaft support arm angular position regulating mechanism 38 for regulating the angle $\phi$ through which the camshaft support arm 30 is turned.

The camshaft support arm angular position regulating mechanism 38 comprises a swing member 42 having a hole 39 in its central portion, swingably supported on a shaft 40 extended through the hole 39 in the lower portion of the cylinder head, and provided with a sector worm gear 41 on its lower end, a rotary shaft 45 supported at its opposite ends in bearings 43 and 44, integrally provided with a worm 45' and disposed with the worm 45' in engagement with the sector worm gear 41, a swing angle detector (AGL detector) 46, such as a potentiometer, connected to one end of the rotary shaft 45 to detect the position of engagement of the sector worm gear 41 and the worm 45', i.e., the angular position of the swing member 42 indicated by the angle $\phi$, and to give a detection signal representing the angle $\phi$ to the ECU 3, and a motor 47 for rotating the rotary shaft 45 according to a command signal provided by the ECU 3.

In the valve control system 12 comprising the valve driving mechanism 16 and the camshaft angular position regulating mechanism 38, the rotary shaft 45 is rotated to swing the swing member 42 in the direction of the arrow B to a position indicated by alternate long and two short dashes lines. Then, the camshaft support arm 30 is turned through an angle $\phi$ in the direction of the arrow C and, consequently, the lever ratio $\eta$ of the rocker arm 29*a* is changed to change the phase of the suction valve 25*a* relative to that of the crankshaft.

Figure 5:
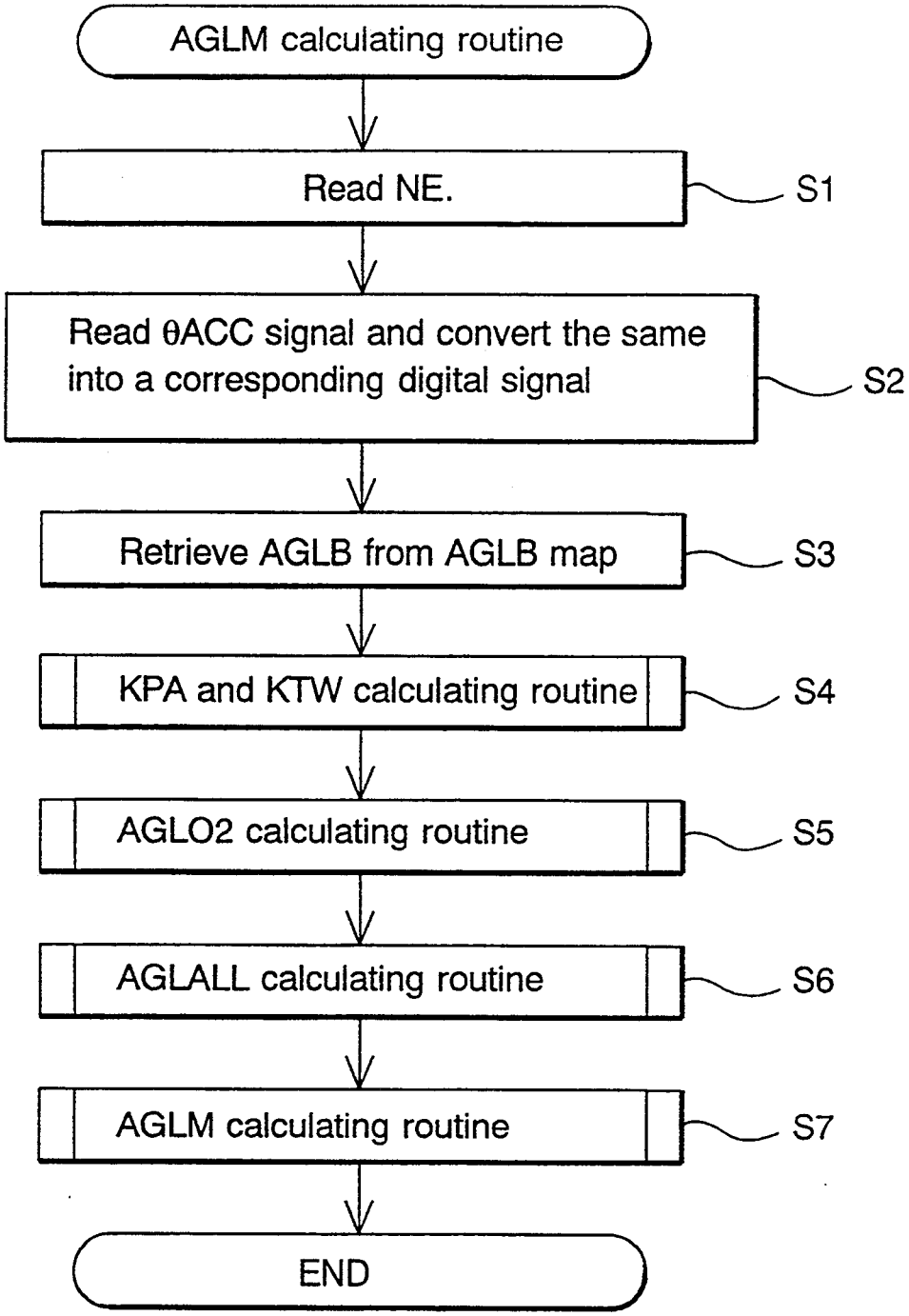
FIG. 5 is a flow chart of an AGLM calculating routine.

FIG. 5 is a flow chart of a desired swing angle calculating routine (AGLM calculating routine) to be executed in synchronism with the TDC detection signal.

Referring to FIG. 5, the engine speed NE is sampled in step S1 and, in step S2, an analog output signal of the ΘACC detector 13 is converted into a corresponding digital signal to detect an accelerator position ΘACC.

In step S3, a basic swing angle AGLB corresponding to the engine speed NE and the accelerator position ΘACC is retrieved from an AGLB map as shown in FIG. 6. The AGLB map shows the basic swing angles AGLB as a function of the engine speed NE (NE1 to NE20) and the accelerator position ΘACC (ΘACC1 to ΘACC17). The basic swing angle AGLB is retrieved from the AGLB map or estimated by interpolation.

In step S4, environmental condition correction factors KPA and KTW are determined. The environmental condition correction factors KPA and KTA are retrieved from a KPA table and a KTA table, not shown, showing the environmental condition correction factors KPA and KTA identified by the atmospheric pressure PA and the intake air temperature TA, respectively, or estimated by interpolation.

In step S5, a swing angle correction AGLO2 for each cylinder is calculated so that a fixed quantity of air dependent on the air-fuel ratio of the present air-fuel mixture will be taken into the cylinder. An AGLO2 calculating routine, not shown, is executed for each cylinder to determine an optimum swing angle correction AGLO2 for each cylinder.

In step S6, a common swing angle correction AGLALL to be commonly applied to all the cylinders is calculated. The common swing angle correction AGLALL is, for example, a function of the environmental condition correction factors KPA and KTA determined in step S4 and the temperature TW of the engine cooling water.

In step S7, a desired swing angle AGLM is calculated by using expression (1), and then the routine is ended.

$$AGLM = AGLB + AGLO2 + AGLALL$$

Then, the swing angle is controlled so that the swing angle AGL detected by the AGL detector 46 will coincide with the desired swing angle AGLM.

The valve controller executes a starting lever ratio setting routine to set an optimum starting lever ratio of the rocker arm 29a optimum for starting the engine 1 in a period from the stoppage of the engine 1 through the duration of cranking to the restart of the engine 1. The starting lever ratio setting routine will be described in detail hereinafter.

Figure 7:
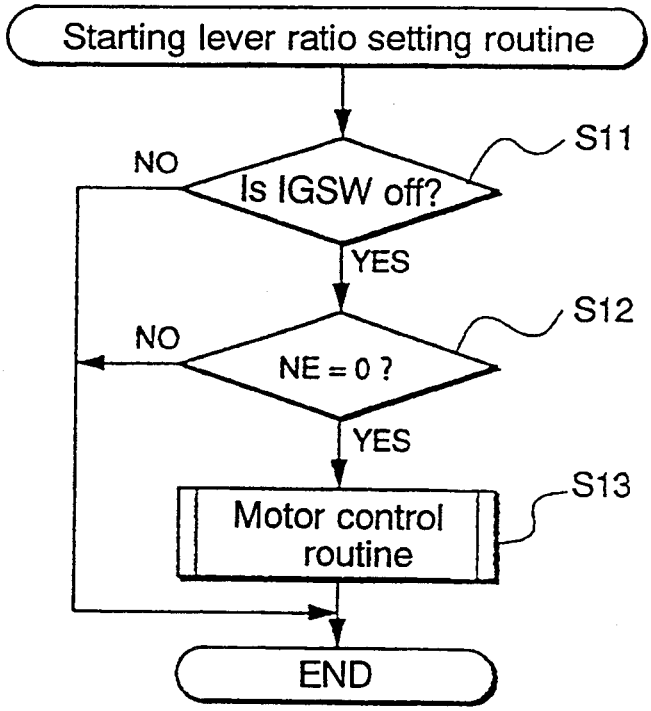
FIG. 7 is a flow chart of a starting lever ratio setting routine in a first embodiment according to the present invention.

FIG. 7 is a flow chart of a starting lever ratio setting routine in a first embodiment according to the present invention.

Referring to FIG. 7, a query is made in step S11 to see if the IGSW 15 is OFF. If the response in step S11 is negative, the routine is ended. If the response in step S11 is affirmative, a query is made in step S12 if the engine speed NE is zero. If the response in step S12 is negative, i.e., if the engine 1 is in operation, the routine is ended. If the response in step S12 is affirmative, it is decided that the engine 1 has just stopped, a motor control routine is executed in step S13 to initialize the motor 47, and then the routine is ended.

Figure 8:
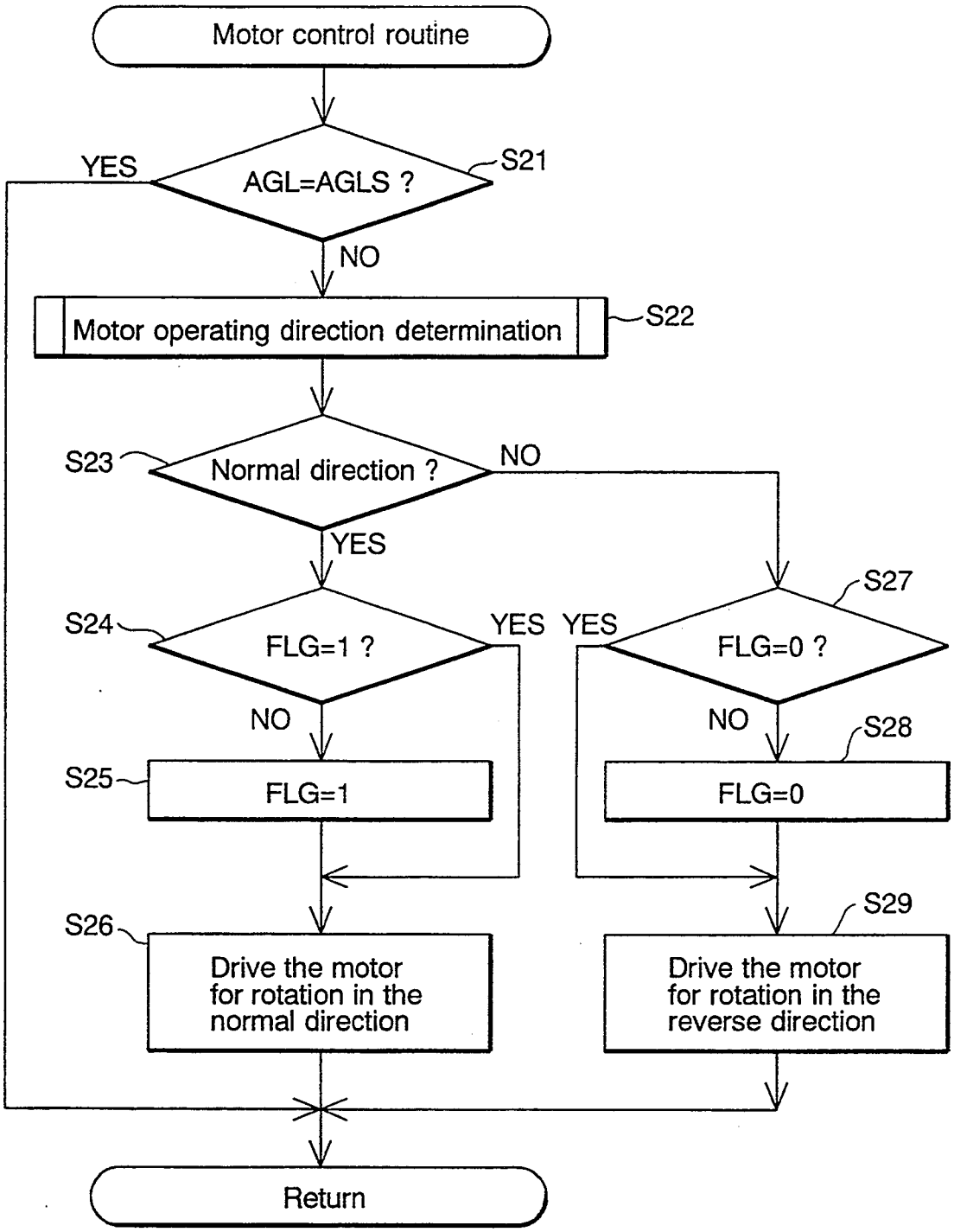
FIG. 8 is a flow chart of a motor control routine.

FIG. 8 illustrates the motor control routine, a query is made in step S21 to see if the present swing angle AGL is equal to an optimum starting swing angle AGLS. The optimum starting swing angle AGLS is set on the basis of the temperature TW of the engine cooling water and the supply voltage VB of the battery and according to a mode of operation of the engine 1 so that the engine 1 can be easily started. For example, the optimum starting swing angle AGLS is determined so as to secure the satisfactory operation of the engine 1 in a high-speed, high-load operating mode when the temperature TW of the engine cooling water is equal to or above a fixed temperature and the engine 1 is warmed up. The optimum starting swing angle AGLS is determined so as to secure the satisfactory operation of the engine 1 in a low-speed, low--load operating mode when the temperature TW of the engine cooling water is not higher than the fixed temperature and the supply voltage VB of the battery is not higher than a fixed voltage.

If the response in step S21 is affirmative, i.e., if the present swing angle AGL is equal to the optimum starting swing angle AGLS, the routine is ended. If the response in step S21 is negative, the direction of rotation of the output shaft of the motor 47, i.e., either the normal direction (clockwise direction) or the reverse direction (counterclockwise direction), is determined in step S22. The swing member 42 is turned in the direction of the arrow D (FIG. 4) when the output shaft of the motor 47 is rotated in the normal direction, and the swing member 42 is turned in the direction of the arrow B (FIG. 4) when the output shaft of the motor 47 rotates in the reverse direction.

In step S23, a query is made to see if the output shaft of the motor 47 must be rotated in the normal direction. If the response in step S23 is affirmative, a query is made in step S24 to see if a normal rotation enable flag FLG is set to "1". The routine goes directly to step S26 if the response in step S24 is affirmative or the routine goes to step S26 after setting the normal rotation enable flag FLG to "1" in step S25 if the response in step S24 is negative. In step S25, the motor 47 is driven for rotation in the normal direction, and then the routine is ended.

On the other hand, if the response in step S23 is negative, a query is made in step S27 to see if the normal rotation enable flag FLG is set to "0". Then, the routine goes to step S29 if the response in step S27 is affirmative or the routine goes to step S29 after setting the normal rotation enable flag FLG to "0" in step S28 if the response in step S27 is negative. Then, the motor 47 is driven for rotation in the reverse direction in step S29, and then the routine is ended.

Thus, the starting lever ratio setting routine in the first embodiment sets an optimum starting swing angle in a fixed period subsequent to the stoppage of the engine 1 after the IGSW 15 has been turned off.

Figure 9:
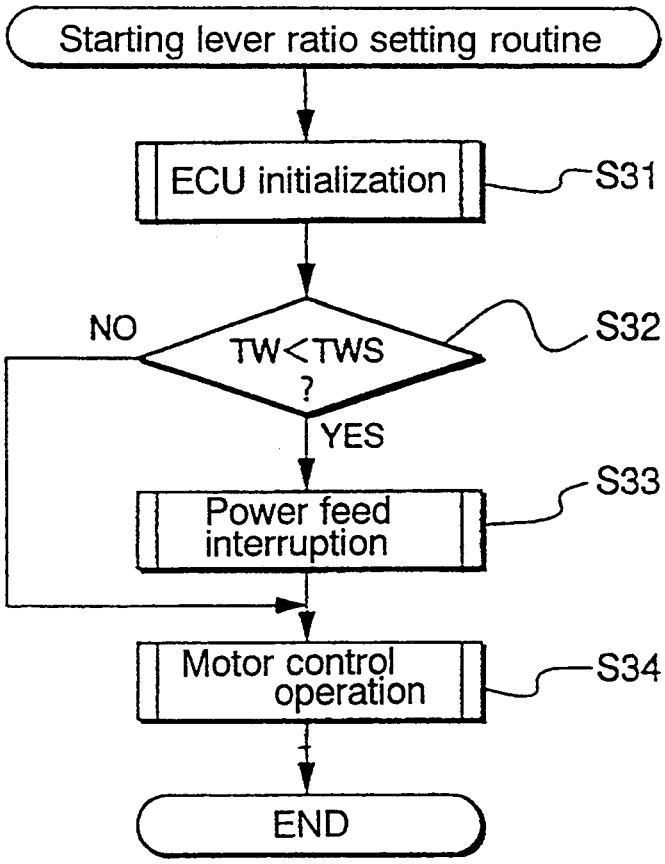
FIG. 9 is a flow chart of a starting lever ratio setting routine in a second embodiment according to the present invention.
Figure 10:
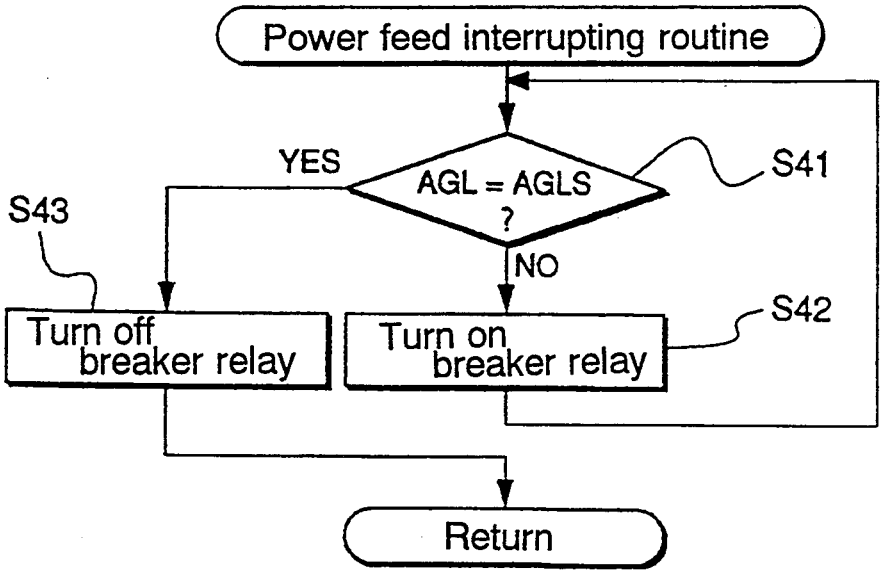
FIG. 10 is a flow chart of a power feed interrupting routine.

FIG. 9 is a flow chart of an optimum starting lever ratio setting routine in a second embodiment according to the present invention. As illustrated in FIG. 9, in step S31, upon the application of an engine start signal to the ECU 3, the ECU 3 is initialized in step S31, and then a query is made in step S32 to see if the temperature TW of the engine cooling water is equal to or below a fixed water temperature TWS, for example, 20° C. The routine goes directly to step S34 if the response in step S32 is negative or the routine goes to step S34 after disconnecting the starting motor from the power supply in step S33 to avoid simultaneously carrying out cranking and the optimum starting swing angle setting operation if the response in step S32 is affirmative. As shown in FIG. 10, a query is made in step S41 to see if the swing angle AGL is equal to the optimum starting swing angle AGLS. If the response in step S41 is negative, a breaker relay is turned on in step S42 to disconnect the starting motor from the power supply so that cranking is interrupted, and steps S41 and S42 are repeated until the response in step S41 becomes affirmative. After the response in step S41 has become affirmative, the breaker relay is turned off to connect the starting motor to the power supply for cranking, and then the routine returns to step S34 to carry out the motor control routine of FIG. 8. After the completion of the motor control routine, the control operation is ended.

The starting lever ratio setting routine in the second embodiment carries out the starting lever ratio setting operation during engine stating operation including cranking and disconnects the starting motor from the power supply during the starting lever ratio setting operation to avoid simultaneously carrying out the starting lever ratio setting operation and cranking in order that the engine 1 can be easily restarted.

Figure 11:
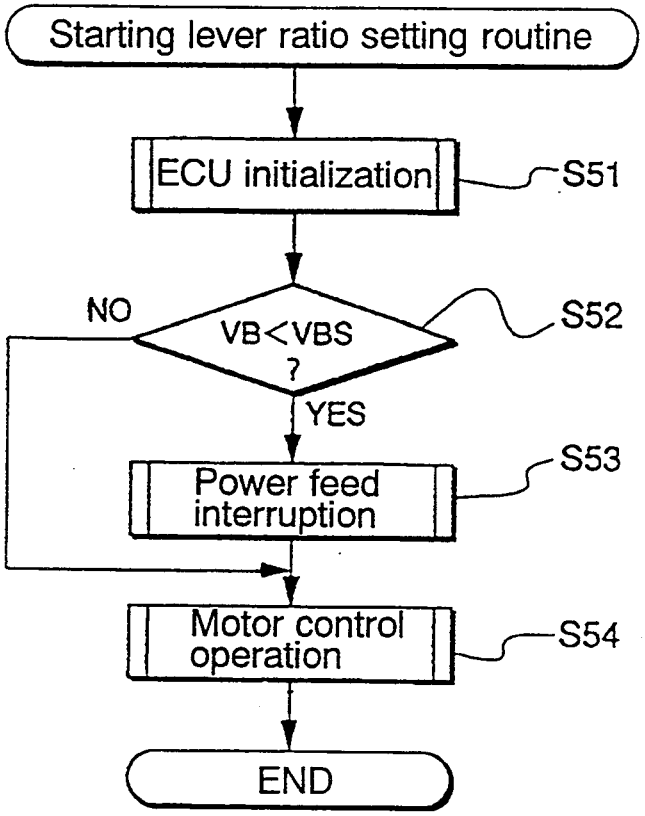
FIG. 11 is a flow chart of a starting lever ratio setting routine in a third embodiment according to the present invention.

FIG. 11 is a flow chart of a starting swing angle setting routine in a third embodiment according to the present invention. Referring to FIG. 11, upon the application of an engine start signal to the ECU 3, the ECU 3 is initialized in step S51, which is similar to step S31 of FIG. 9. In step S52, a query is made in step S52 to see if the supply voltage VB of the battery is equal to or below a fixed voltage VBS. The routine goes directly to step S54 if the response in step S52 is negative or the routine goes to step S54 after disconnecting the starting motor from the power supply in step S53 to avoid simultaneously carrying out cranking and starting lever ratio setting operation. Steps similar to those shown in FIG. 10 are executed to interrupt cranking by keeping the starting motor disconnected from the power supply during the starting swing angle setting operation. After a starting swing angle AGLS has been set (AGL=AGLS), the starting motor is connected to the power supply for cranking. In step S54, the routine shown in FIG. 8 is executed to control the motor, and then the routine is ended.

Thus, the starting lever ratio setting routine in the third embodiment, similarly to the starting lever ratio setting routine in the second embodiment, carries out the starting lever ratio setting operation during the engine starting operation including cranking and avoids simultaneously carrying out the starting lever ratio setting operation and cranking by disconnecting the starting motor from the power supply in order that the engine 1 can be easily restarted.

The present invention is not limited in its practical application to the foregoing embodiments and many changes and variations are possible therein without departing from the scope thereof. For example, the present invention is applicable to a valve control system which mechanically detects the lever ratio of the rocker arm of the valve driving mechanism, i.e., the angular position of the cam-shaft support arm.

Figure 12:
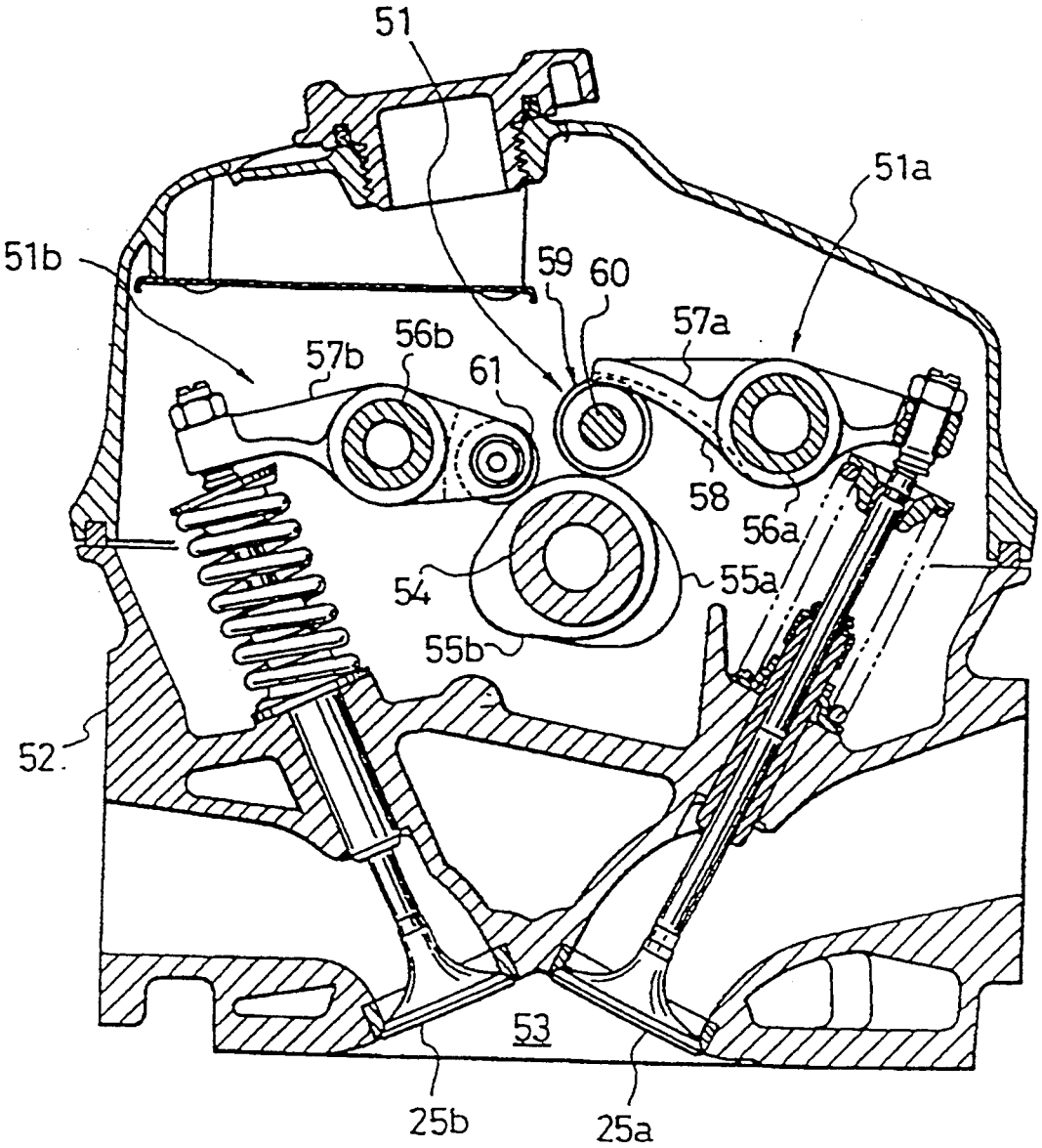
FIG. 12 is a sectional view of a valve driving mechanism in another embodiment according to the present invention.
Figure 13:
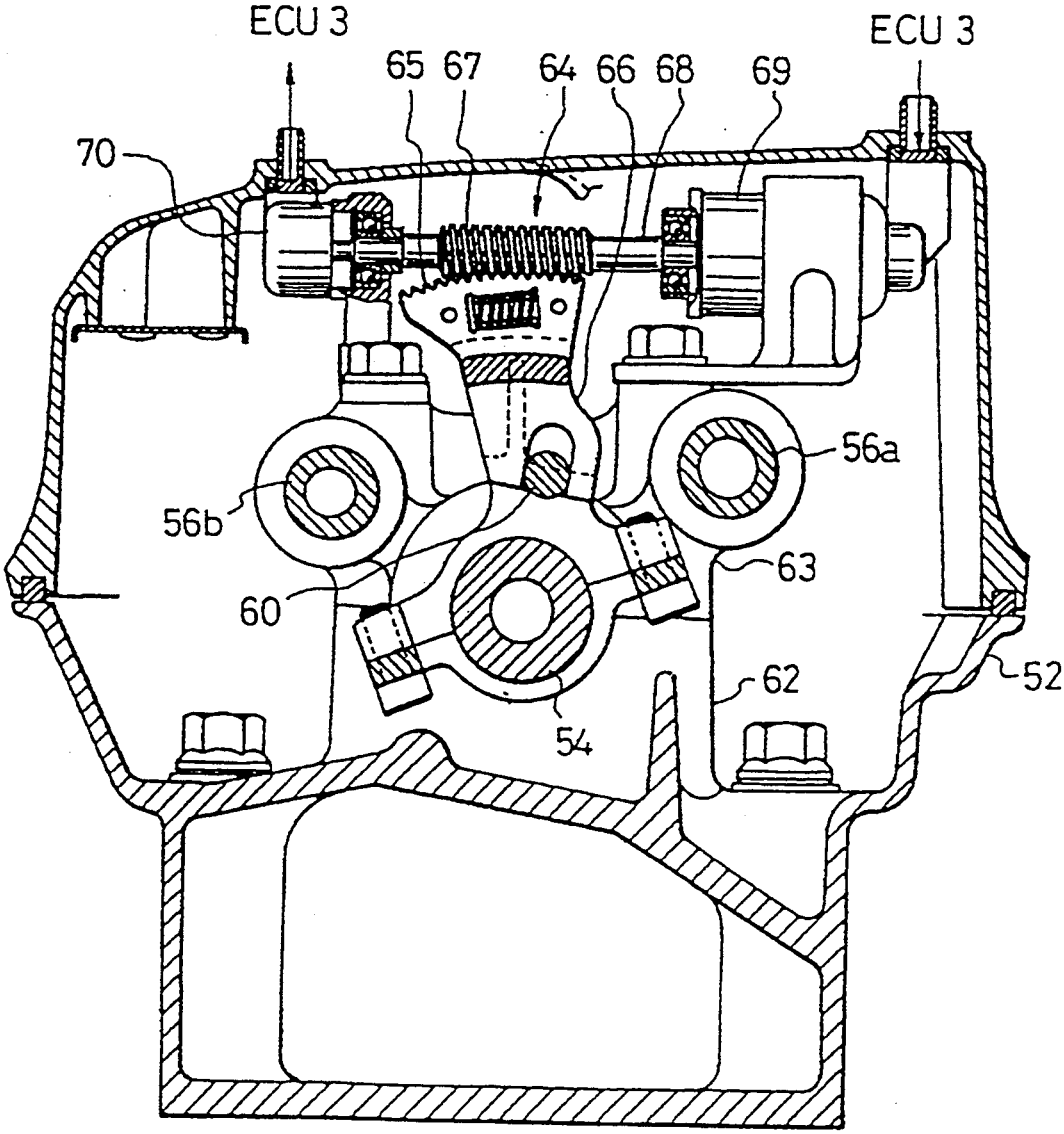
FIG. 13 is a sectional view of a swing angle regulating mechanism included in the valve driving mechanism of FIG. 12.

FIG. 12 is a sectional view of a valve driving mechanism in another embodiment according to the present invention, and FIG. 13 is a camshaft support arm angular position regulating mechanism included in the valve driving mechanism of FIG. 12.

The valve driving mechanism 51 comprises a camshaft. 54 disposed above combustion chambers 53 formed in a cylinder head 52, suction valve driving cams 55*a* fixedly mounted on the camshaft 54, and exhaust valve driving cams 55*b* fixedly mounted on the camshaft 54. The cams 55*a* and 55*b* rotates together with the camshaft 54.

A suction valve driving mechanism 51*a* comprises a shaft 55*a*, rocker arms 57*a* swingably supported on the shaft 55*a* and each having a slipper surface 58, and a cam follower 59 supported for rotation on a shaft 60 and disposed between each suction valve driving cam 55*a* and the slipper surface 58 of each rocker arm 57*a*.

An exhaust valve driving mechanism 5l*b* comprises a shaft 56*b*, rocker arms 57*b* swingably supported on the shaft 56*b*, and a cam follower 61 supported for rotation on the extremity of each rocker arm 57*b* so as to be in contact with the exhaust valve driving cam 55*b*.

As shown in FIG. 13, the camshaft 54 is held for rotation between a cam journal 62 formed integrally with the cylinder head 52, and a cam holder 63. The lever ratio of the rocker arms 57*a* is regulated by a camshaft support arm angular position regulating mechanism 64.

The camshaft support arm angular position regulating mechanism 64 comprises a guide bridge 66 provided with a sector worm gear 65 on its upper end, a rotary shaft 68 integrally provided with a worm 67 and disposed with the worm 67 in mesh with the sector worm gear 65, a motor 69 for rotating the rotary shaft 68 according to a command given thereto by the ECU 3, an AGL detector 70, such as a potentiometer, which detects a fixed position of engagement of the sector worm gear 65 and the worm 67 and gives a detection signal to the ECU 3. When the motor 69 drives the rotary shaft 68 for rotation, the guide bridge 66 turns on the camshaft 54 together with the shaft 60 to shift the cam follower 59 and, consequently, the lever ratio of the rocker arm 57*a* is changed according to the movement of the cam follower 59.

The valve driving mechanism 51 thus constructed executes the AGLM calculating routine shown in FIG. 5 to calculate a desired swing angle AGLM and to control intake air flow. The valve driving mechanism 51 executes also one of the starting lever ratio setting routines in the first to the third embodiments shown in FIGS. 7 to 11 to determine an optimum starting swing angle optimum for restarting the engine so that the engine can be easily restarted.

As is apparent from the foregoing description, the valve controller for an internal-combustion engine according to the present invention comprises the lever ratio detecting means for detecting the lever ratio of the rocker arm; the operating condition detecting means for detecting the operating conditions of the internal-combustion engine including at least the load on the internal-combustion engine and the engine speed of the internal-combustion engine; the air-fuel ratio detecting means for detecting the air-fuel ratio of the air-fuel mixture on the basis of the oxygen concentration of the exhaust gas; the desired lever ratio calculating means for calculating a desired lever ratio on the basis of detection signals provided by the operating condition detecting means and the air-fuel ratio detecting means; the lever ratio regulating means for adjusting the lever ratio detected by the lever ratio detecting means to the desired lever ratio calculated by the desired lever ratio calculating means; and the starting lever ratio setting means for setting an optimum starting lever ratio optimum for the operation of the internal-combustion engine in a period from the stoppage of the internal-combustion engine to the restart of the same including cranking when restarting the internal-combustion engine, and the valve controller is capable of properly timing the operation of the valves when starting the internal-combustion engine.

Since the lever ratio of the rocker arms can be set to an optimum value according to the temperature of the cooling water, the supply voltage of the battery and the like, an optimum valve timing operation can be achieved when starting the internal-combustion engine.

The starting lever ratio setting means sets an optimum starting lever ratio in a period from the stoppage of the internal-combustion engine to the restart of the same or during engine restarting operation including cranking. When the starting lever ratio setting operation is carried out during engine restarting operation including cranking, the power feed control means disconnects the starting motor from the power supply when the temperature of the cooling water is not higher than a fixed temperature or the supply voltage of the battery is not higher than a fixed voltage, and connects the starting motor to the power supply after the starting lever ratio has been set. Accordingly, a desired starting lever ratio can be surely set when restarting the internal-combustion engine to ensure that the internal-combustion engine can be easily started.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve controller for controlling an intake valve of an internal-combustion engine, the internal-combustion engine comprising a cylinder head, intake and exhaust camshafts having cams engaged therewith and being disposed in an upper portion of the cylinder head, an exhaust valve, rocker arms pivotally supported on intake and exhaust rocker shafts so as to be driven for rocking motion by respective cams of the intake and exhaust camshafts to respectively operate the intake valve and the exhaust value, a lever ratio of the respective rocker arm of the intake valve specifying a distance between an axis of the intake rocker shaft and a point at which the respective cam applies pressure to the respective rocker arm, the lever ratio being variable to regulate intake air flow, the valve controller comprising:

lever ratio detecting means for detecting the lever ratio of the respective rocker arm;

operating condition detecting means for detecting operating conditions of the internal-combustion engine including at least a load on the internal-combustion engine and an engine speed of the internal-combustion engine;

air-fuel ratio detecting means for detecting an air-fuel ratio of an air-fuel mixture on the basis of an oxygen concentration of an exhaust gas of the internal-combustion engine;

desired lever ratio calculating means for calculating a desired lever ratio on the basis of detection signals provided by said operating condition detecting means and said air-fuel ratio detecting means;

lever ratio regulating means for adjusting the lever ratio detected by said lever ratio detecting means to the desired lever ratio calculated by said desired lever ratio calculating means; and starting lever ratio setting means for setting an optimum starting lever ratio for operation of the internal-combustion engine during a period from stoppage of the internal-combustion engine to restart of the internal-combustion engine, including cranking when restarting the internal-combustion engine.

2. The valve controller of claim 1, further comprising:

water temperature detecting means for detecting a temperature of engine cooling water; and voltage detecting means for detecting a supply voltage of a battery, wherein said starting lever ratio setting means determines the optimum starting lever ratio on the basis of at least either one of the detected temperature provided by said water temperature detecting means and the detected supply voltage provided by said voltage detecting means.

3. The valve controller of claim 1, wherein said starting lever ratio setting means functions during a predetermined period after the internal-combustion engine has stopped.

4. The valve controller of claim 1, wherein said starting lever ratio setting means functions during cranking when starting the internal-combustion engine.

5. The valve controller of claim 4, further comprising:

water temperature detecting means for detecting a temperature of engine cooling water; and power feed control means for inhibiting power feed to a starting motor when the temperature of the engine cooling water detected by said water temperature detecting means is equal to or below a fixed temperature and removing the inhibition of power feed to said starting motor when an optimum starting lever ratio is set by said starting lever ratio setting means.

6. The valve controller of claim 4, further comprising:

voltage detecting means for detecting a supply voltage of a battery; and power feed control means for inhibiting power feed to a starting motor when the supply voltage of the battery is equal to or below a fixed voltage and removing the inhibition of power feed to said starting motor when an optimum lever ratio is set by said starting lever ratio setting means.

7. The valve controller of claim 2, wherein said starting lever ratio setting means functions during a predetermined period after the internal-combustion engine has stopped.

8. The valve controller of claim 2, wherein said starting lever ratio setting means functions during cranking when starting the internal-combustion engine.

9. The valve controller of claim 8, further comprising:

power feed control means for inhibiting power feed to a starting motor when the temperature of the engine cooling water detected by said water temperature detecting means is equal to or below a fixed temperature and removing the inhibition of power feed to said starting motor when an optimum starting lever ratio is set by said starting lever ratio setting means.

10. A method of controlling an intake valve of an internal-combustion engine, the internal-combustion engine comprising a cylinder head, intake and exhaust camshafts having cams engaged therewith and being disposed in an upper portion of the cylinder head, an exhaust valve, rocker arms pivotally supported on intake and exhaust rocker shafts so as to be driven for rocking motion by respective cams of the intake and exhaust camshafts to respectively operate the intake valve and the exhaust valve, a lever ratio of the respective rocker arm of the intake valve specifying a distance between an axis of the intake rocker shaft and a point at which the respective cam applies pressure to the respective rocker arm, the lever ratio being variable to regulate intake air flow, the method of controlling the intake valve comprising the steps of:

(a) detecting the lever ratio of the respective rocker arm;

(b) detecting operating conditions of the internal-combustion engine including at least a load on the internal-combustion engine and an engine speed of the internal-combustion engine;

(c) detecting an air-fuel ratio of an air-fuel mixture on the basis of an oxygen concentration of an exhaust gas of the internal-combustion engine;

(d) determining a desired lever ratio on the basis of detection signals generated during said step (b) and said step (c);

(e) adjusting the lever ratio detected during said step (a) to the desired lever ratio determined during said step (d); and (f) setting an optimum starting lever ratio for operation of the internal-combustion engine during a period from stoppage of the internal-combustion engine to restart of the internal-combustion engine, including cranking when restarting the internal-combustion engine.

11. The method of controlling an intake valve of claim 10, further comprising the steps of:

(g) detecting a temperature of engine cooling water; and (h) detecting a supply voltage of a battery, wherein the optimum starting lever ratio is determined during said step (f) on the basis of at least either one of the detected temperature and the detected supply voltage.

12. The method of controlling an intake valve of claim 10, wherein said step (f) occurs during a predetermined period after the internal-combustion engine has stopped.

13. The method of controlling an intake valve of claim 10, wherein said step (f) occurs during cranking when starting the internal-combustion engine.

14. The method of controlling an intake valve of claim 13, further comprising the steps of:

(g) detecting a temperature of engine cooling water; and (h) inhibiting power feed to a starting motor when the detected temperature of the engine cooling water is equal to or below a fixed temperature and subsequently removing the inhibition of power feed to the starting motor upon setting of an optimum starting lever ratio.

15. The method of controlling an intake valve of claim 13, further comprising the steps of:

(g) detecting a supply voltage of a battery; and (h) inhibiting power feed to a starting motor when the supply voltage of the battery is equal to or below a fixed voltage and subsequently removing the inhibition of power feed to the starting motor upon setting of an optimum lever ratio.

16. The method of controlling an intake valve of claim 11, wherein said step (f) occurs during a predetermined period after the internal-combustion engine has stopped.

17. The method of controlling an intake valve of claim 11, wherein said step (f) occurs during cranking when starting the internal-combustion engine.

18. The method of controlling an intake valve of claim 17, further comprising the step of:

(g) inhibiting power feed to a starting motor when the detected temperature of the engine cooling water is equal to or below a fixed temperature and subsequently removing the inhibition of power feed to the starting motor upon setting of an optimum starting lever ratio.

* * * * *